US007010920B2

(12) United States Patent
Saranchuk et al.

(10) Patent No.: US 7,010,920 B2
(45) Date of Patent: Mar. 14, 2006

(54) LOW TEMPERATURE HEAT ENGINE

(75) Inventors: Theodore Charles Saranchuk, Northwood, OH (US); Donald Edward Marksberry, Carrollton, TX (US)

(73) Assignee: Terran Technologies, Inc., Carrollton, TX (US)

( * ) Notice: Subject to any disclaimer, the term of this patent is extended or adjusted under 35 U.S.C. 154(b) by 0 days.

(21) Appl. No.: 10/743,968

(22) Filed: Dec. 23, 2003

(65) Prior Publication Data

US 2004/0182082 A1 Sep. 23, 2004

Related U.S. Application Data

(60) Provisional application No. 60/436,536, filed on Dec. 26, 2002.

(51) Int. Cl.
*F01K 1/00* (2006.01)

(52) U.S. Cl. ..... 60/670; 60/685; 60/690

(58) Field of Classification Search ..... 60/670, 60/685, 691, 692, 693
See application file for complete search history.

(56) References Cited

U.S. PATENT DOCUMENTS

| | | | | |
|---|---|---|---|---|
| 3,636,706 | A | 1/1972 | Minto | |
| 3,766,732 | A * | 10/1973 | Woodcock | 60/685 |
| 3,803,846 | A * | 4/1974 | Letvin | 60/685 |
| 4,089,177 | A * | 5/1978 | Olofsson | 60/688 |
| 4,272,961 | A * | 6/1981 | Sadhukhan | 60/641.3 |
| 4,291,538 | A * | 9/1981 | Husain et al. | 60/661 |
| 4,366,675 | A * | 1/1983 | Nishioka | 60/693 |

(Continued)

FOREIGN PATENT DOCUMENTS

JP 05044405 2/1993

*Primary Examiner*—Hoang Nguyen
(74) *Attorney, Agent, or Firm*—MacMillan, Sobanski & Todd, LLC

(57) ABSTRACT

A method for producing power to drive a load (17) using a working fluid circulating through a system that includes a prime mover (12) having an inlet and an accumulator (20) containing discharge fluid exiting the prime mover. A stream of heated vaporized fluid is supplied at relatively high pressure to the prime mover inlet and is expanded through the prime mover (12) to a lower pressure discharge side where discharge fluid enters an accumulator (20). The discharge fluid is vaporized by passing it through an expansion device (28) across a pressure differential to a lower pressure than the pressure at the prime mover discharge side. Latent heat of condensation in the discharge fluid being discharged from the prime mover is transferred by a heat exchanger (14) to discharge fluid that has passed through the expansion device (28). Vaporized discharge fluid, to which heat has been transferred from fluid discharged from the prime mover, can be returned through a compressor (20) and vapor drum (34) to the prime mover inlet. Vaporized discharge fluid can be removed directly from the accumulator (20) by a compressor (16) where it is pressurized slightly above the pressure in the vapor drum (34), to which it is delivered directly, or it can be passed through a heat exchanger (50) where the heat from the compressed fluid is transferred to an external media after leaving the compressor (16) in route to the vapor drum (34). Liquid discharge fluid from the accumulator (20) is pumped to a boiler liquid drum (32), then to the vapor drum (34) through a heat exchanger (10). The liquid discharge fluid may be expanded through an orifice (62) to extract heat from an external source at heat exchanger (56) and discharged into the vapor drum (34) or the accumulator (20), depending on its temperature upon leaving heat exchanger (56).

29 Claims, 2 Drawing Sheets

U.S. PATENT DOCUMENTS

| | | | |
|---|---|---|---|
| 4,449,368 | A | 5/1984 | Haynie |
| 4,506,508 | A | 3/1985 | Coers et al. |
| 5,507,145 | A | 4/1996 | Kurten et al. |
| 5,699,666 | A | 12/1997 | Kurten et al. |
| 6,041,604 | A | 3/2000 | Nicodemus |
| 6,233,938 | B1 | 5/2001 | NIcodemus |
| 6,347,520 | B1 | 2/2002 | Ranasinghe et al. |
| 6,769,256 | B1 | 8/2004 | Kalina |
| 2002/0162330 | A1 | 11/2002 | Shimizu et al. |
| 2004/0050048 | A1 | 3/2004 | Kalina |

* cited by examiner

LOW TEMPERATURE HEAT ENGINE

CROSS-REFERENCE TO RELATED APPLICATION

This application claims the benefit of U.S. Provisional Patent Application Ser. No. 60/436,536, filed Dec. 26, 2002, the disclosure of which is incorporated herein by reference.

BACKGROUND OF THE INVENTION

Heat engines using air, steam, mixtures of air and steam, and other working media have been used for over a century, and most of these use a single gaseous fluid as a working medium. The steam engine, especially the steam turbine, has been the most popular and successful heat engine, and present commercial steam engines have maximum efficiencies of less than 40% in converting the energy available from fuel into shaft work. Steam engines and other workable heat engines have used an external heat sink, either by direct discharge to the environment in an open cycle or to a condenser for a closed steam cycle system. It is not necessary to use a condenser to reject this latent heat to the environment. Under certain conditions, the latent heat of the prime mover can be transferred to a different portion of the system.

The temperature of compressed air discharged from an air motor after having accomplished work is very cold because heat had been extracted in the form of work. This observation led to the conclusions, based on calculations of state, that it would be possible to extract sufficient energy in the form of mechanical work from a system loaded near the stall point so that all the vapor would be liquefied in the prime mover. This is equally applicable to a piston motor, vane motor or turbine.

The range of operation is, however, extremely narrow and operation outside the range in either over-loaded or insufficiently loaded conditions will cause the unit to shut down. In this mode of operation, all the available heat energy is transferred to the mechanical work portion of the process.

With the prime mover properly loaded, the heat of condensation is available to perform shaft work. This is especially true and has been observed in piston, vane and impulse turbines, and it is a condition to be avoided in reaction turbines and in most vane-type impulse turbines to prevent their destruction. Terry turbines will typically condense 70 to 80 per cent of the vapor.

While the above-described process can produce mechanical work, much energy would be lost in the gearing required to increase the rotational speed of the output shaft. A methodology exists, however, to extend the range of operation of the prime mover from the stall point to where useable amounts of shaft work can be extracted.

SUMMARY OF THE INVENTION

With the use of low temperature boiling fluids having a positive Joule-Thompson coefficient in the operating range of the process, notably, but not limited to refrigerants and liquefied gasses, the process of this invention enables the system to produce useable shaft work at ambient and lower temperatures provided the heat content of the heat source is high enough for that fluid.

The discharge from the primary power source, such as a turbine, is directed into what is effectively a counter-flow heat exchanger, which can also be the condensate storage unit. This heat exchanger transfers remaining energy above the temperature of the fluid at the pressure in the storage unit. Heat exchanger is also referred to as an accumulator because it both condenses and stores the working fluid. These steps can be performed by two components, but it is more practical to combine them. The back pressure in the accumulator is maintained such that the temperature of the stored working fluid is significantly below the boiling temperature of the working fluid, e.g. R-134A.

This cold liquid is expanded through a flow restricting device to a significantly lower pressure state where it is expanded isobarically and absorbs the latent heat remaining in the saturated turbine discharge vapor. In the example discussed here, the isobaric expansion occurs at 4 psia, which has an effective temperature of −60 degrees F. This vapor absorbs the remaining latent heat of condensation in the discharge of the prime mover, resulting in a complete liquefaction of the discharge. As demonstrated in the Von Linde process for atmospheric gas liquefaction, only a tiny mass fraction has to be evaporated to accomplish this effect. This can also be accomplished by expanding cold vapor as well as liquid. However, expanding vapor is a less efficient method of removing the latent heat. Further, the direct removal of the vapor in the accumulator via the suction of a compressor that discharges into the prime mover header could keep the accumulator pressure at the desired level.

A method for producing power to drive a load using a working fluid circulating through a system that includes a turbine having an inlet and an accumulator containing discharge fluid exiting the turbine. A high velocity stream of heated vaporized fluid is supplied at relatively high pressure to the turbine inlet and expanded through the turbine to a lower pressure discharge side of the turbine where discharge fluid exits the turbine. The discharge fluid is vaporized by passing the discharge fluid through an expansion device across a pressure differential to a lower pressure than the pressure at the turbine discharge side. Latent heat of condensation is transferred from the discharge fluid being discharged from the turbine to the discharge fluid that has passed through the expansion device. Expanded discharge fluid, to which heat has been transferred from fluid discharged from the turbine, is returned, vaporized, to the turbine inlet.

Another aspect of this invention is a system for generating power using a fluid in which energy is stored and removed. The system includes a prime mover, such as a turbine, for driving a load, and having an inlet and discharge side, though which prime mover heated vaporized fluid at relatively high pressure is expanded to a lower pressure at the discharge side where discharge fluid exits. An accumulator contains discharge fluid from the prime mover. Discharge fluid from the accumulator is vaporized by passing it through an expansion orifice across a pressure differential to a lower pressure than the pressure at the turbine discharge side. A first heat exchanger transfers latent heat of condensation from discharge fluid being discharged from the turbine to the discharge fluid that has passed through the expansion device. A boiler further heats and vaporizes discharge fluid to which heat has been transferred from fluid discharged from the turbine. A compressor pumps vaporized fluid from the heat exchanger to the boiler, and a pump delivers liquid fluid from the accumulator to the boiler.

DETAILED DESCRIPTION OF THE PREFERRED EMBODIMENT

Figure 1:
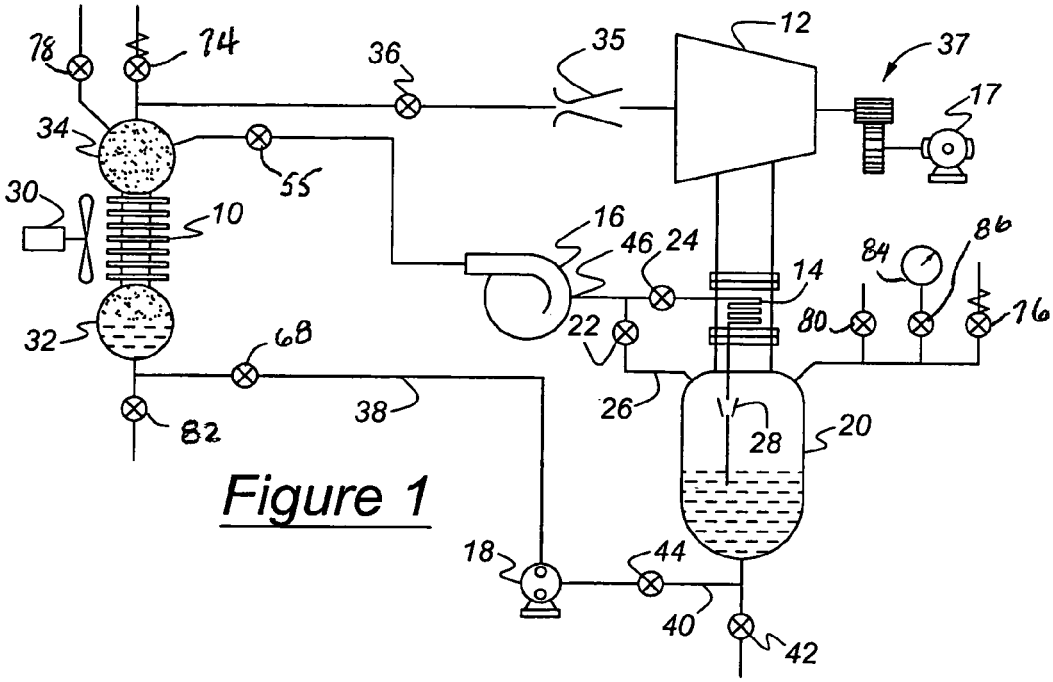
FIG. 1 is a schematic diagram showing the components of a low temperature heat engine system according to this invention.

FIG. 1 illustrates a system that includes a heat exchanger 10, which functions as a boiler; a prime mover 12 such as turbine 12, which is the primary extractor of heat in the form of work; and a heat exchanger 14, which function as a cooler; and an accumulator 20, a storage vessel containing discharge fluid that has passed through the prime mover. Compressor 16 draws suction from the condensate in accumulator 20 through line 26 and valve 22 to the inlet side of the compressor. Liquid condensate, drawn by compressor 16 from accumulator 20 through an expansion device 28, expands through the expansion device 28 into a low pressure volume of heat exchanger 14, the cold side. The condensate or discharge fluid flash boils at the heat exchanger 14 and extracts latent heat from the discharge fluid leaving turbine 12. The expanded vapor is then scavenged by compressor 16, which maintains low pressure in accumulator 20, is compressed to a higher pressure, and is injected into a steam drum portion 34 of heat exchanger 10.

Not shown are shaft couplings, belts and sheaves and other items that driveably connect the pump 18, compressor 16 and the load. In the example described, the load is an electric generator 17 driven by the turbine 12.

The power capacity of the system described with reference to FIG. 1 is about fifteen horsepower. The working fluid is Refrigerant 134-a, although other fluids can be used. The calculations and equations of state follow the process description. Pressure, temperature and enthalpy references are from Du Pont Suva 134-a thermodynamic properties tables.

The low-pressure side of the turbine 12 is first decreased to 14 psia by driving compressor 16 from an external source, such as a motor. Feed pump 18, a positive displacement pump, may also be used or substituted for the compressor 16 in reducing the turbine outlet pressure to 14 psia. Because the pressure is at 14 psia, the liquid in the accumulator 20 is maintained at a temperature of −17° F. by flash evaporation. A valve 22, directly connecting accumulator 20 through fluid line 26 to the compressor 16 inlet, is closed. A valve 24, connecting the compressor 16 to heat exchanger 14 and expansion device 28, is opened. The compressor 16 expands liquid discharge fluid drawn from accumulator 20 through expansion device 28, preferably an orifice, and in order to vaporize the discharge fluid in heat exchanger 14 at a pressure of 4 psia. Heat from discharge fluid exiting the turbine is transferred in heat exchanger 14 to vaporized fluid that has passed through expansion device 28. The vaporized fluid that has passed through expansion device 28 is at a temperature of −60° F. The compressor 16 pumps vaporized discharge fluid into the steam drum 34 of the boiler 10.

Heat from an external heat source is transferred at heat exchanger 10 to the working fluid. This heat can be from any source compatible with the fluid being used, such as process cooling water or ambient air. For purposes of this example, air at +45° F. is used. Fans or blowers 30 force air through a tube fin heat exchanger 10 configured as a boiler, which includes a boiling tank 32 and a steam drum 34.

Vapor exiting boiler 10 is expanded in a convergent/divergent nozzle 35 such that the pressure differential between the boiler side and the back pressure side of the prime move 12 is converted into velocity. The prime mover may be an impulse turbine. Although other prime movers could be used, a bladeless disk turbine 12 is preferred because of the significantly greater resistance to destruction that disk turbines provide under the conditions of this system compared to bladed turbines. A bladeless disk turbine is also known as a Tesla turbine. Disk pumps are capable of pumping boiling water, and disk turbines are not destroyed by condensate passing through the boundary layers of the disks. Disk turbines the power range of this system can also be obtained at significantly lower cost than either piston engines or bladed turbines, and they can be very efficient in the range up to 100 kilowatts. Alternative prime movers include a blade turbine, a centrifugal turbine, a vane motor, and a piston motor.

Preferably the disk turbine 12 has approximately a six inch diameter and the rotational speed is 7200 rpm to allow the speed to be stepped down by a speed reducer 37 to 3600 rpm, or 60 Hz to drive the generator 17. The nozzle diameter is approximately 0.25 inch diameter. The determinations of nozzle size, disk spacing, disk thickness and number of disks is included with the calculations to demonstrate a preferred design.

The high velocity fluid exits the divergence of the nozzle 35 and enters the disk turbine 12, traveling approximately fourteen linear feet before exiting the discharge side of the turbine. The turbine produces power to drive the generator load 17, which is driveably connected through a 2:1 speed reducer 37 to the turbine shaft. The compressor 16, fan/blower 30, and feed pump 18 can be mechanically driven from the turbine shaft or from the electrical output of the generator 17. Horsepower requirements for these components are given in the calculations that follow. The rotary inertia of the generator 17 suffices for the initial system load.

The condensed fluid and any remaining vapor at 14 psia, the back pressure of the turbine, is at −17 (−16.8)° F. as the discharge fluid exits the turbine and flows to accumulator 20. The discharge fluid exiting the turbine 12 transfers its latent heat in heat exchanger 14 to the −60° F. vaporized fluid that has passed through expansion device 28 and flows to the compressor inlet or suction intake 46. Preferably, this heat exchange completely liquefies the turbine discharge fluid using the Von Linde process. Preferably, heat exchanger 14 is a counter-flow heat exchanger, located in accumulator 20 with the discharge fluid from turbine 12.

When the process is shut down, the heat source 10 and electrical load 17 are removed, the feed pump 18 and compressor 16 are then stopped, and the turbine 12 and accumulator 20 are isolated by closing valves 22, 24, 36, and 44.

The process requires a load to function properly. When no load is present, a high back pressure results, and reduced output or no output is produced.

Vaporized discharge fluid can be removed by compressor 16 directly from the accumulator 20 without passing through expansion device 28 or heat exchanger 14. The compressor 16 draws vaporized discharge fluid from accumulator 20 and pressurizes the vaporized discharge fluid slightly above the pressure in the vapor drum 34, to which it is delivered through valve 55. Alternatively, vaporized discharge fluid pumped by compressor 16 from accumulator 20 can be passed through valves 52, 54 and heat exchanger 50, where heat from the compressed discharge fluid is transferred to an external media after leaving the compressor 16 en route to the vapor drum 34. Heat exchanger 50 extracts latent heat from at least a portion of the compressor discharge fluid and transfers that heat to another fluid that flows through heat exchanger 50 to a heat sink, or to provide a heat source for a building or for another purpose. Discharge fluid leaving compressor 16 is either delivered to vapor drum 34, from which it is returned to the turbine inlet, or it is returned to accumulator 20, as described with reference to FIG. 3.

FIG. 1 shows that liquid discharge fluid from accumulator 20 is pumped through lines 38, 40 by a positive displacement pump 18 to a boiler liquid drum 32, where it is heated upon passing through heat exchanger 10. The liquid discharge fluid is vaporized by heat transferred in the heat exchanger 10 from a media such as air or another external fluid.

Figure 2:
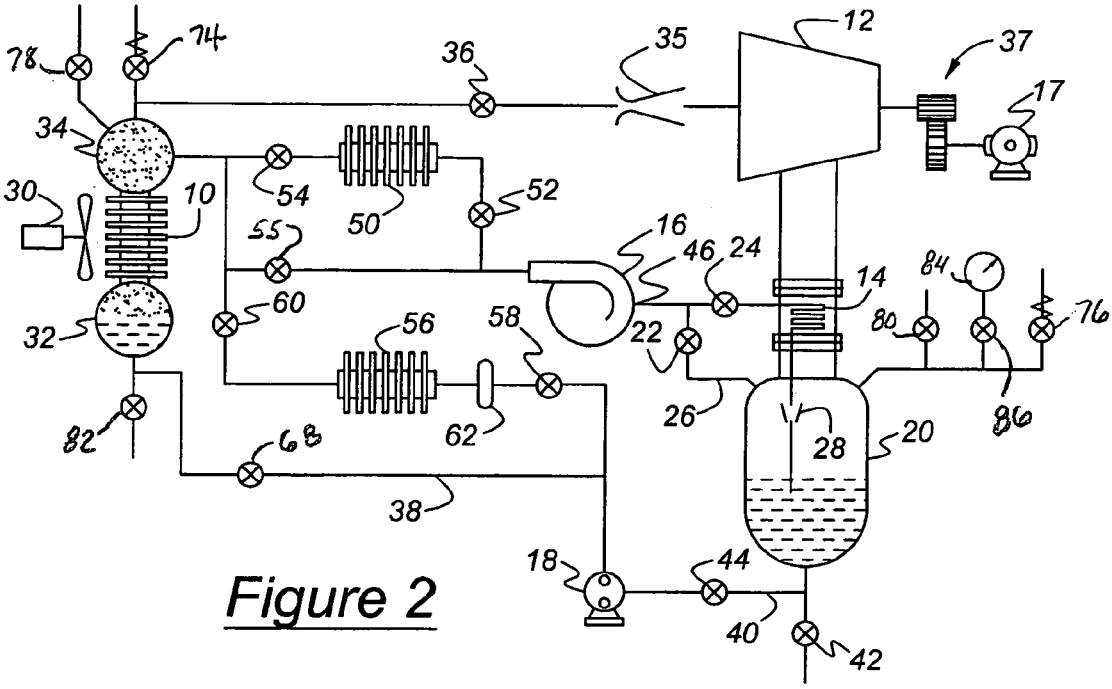
FIG. 2 is a schematic diagram showing an alternate embodiment of the system of FIG. 1.

FIG. 2 shows that liquid discharge fluid from pump 18 may travel an alternate path through valve 58 and an expansion device 62, which is preferably an orifice, to a heat exchanger 56. Temperature of the liquid discharge fluid is reduced upon expansion through orifice 62, and the discharge fluid is heated in heat exchanger 56 where it extracts heat from an external heat source, such as fluid from a process or the environment. Heated discharge fluid leaving heat exchanger 56 passes through valve 60 en route to the vapor drum 34. Heat exchangers 50, 56 allow heat input to, and/or heat output from the system directly from the working fluid in addition to the normal output of the prime mover 12.

Figure 3:
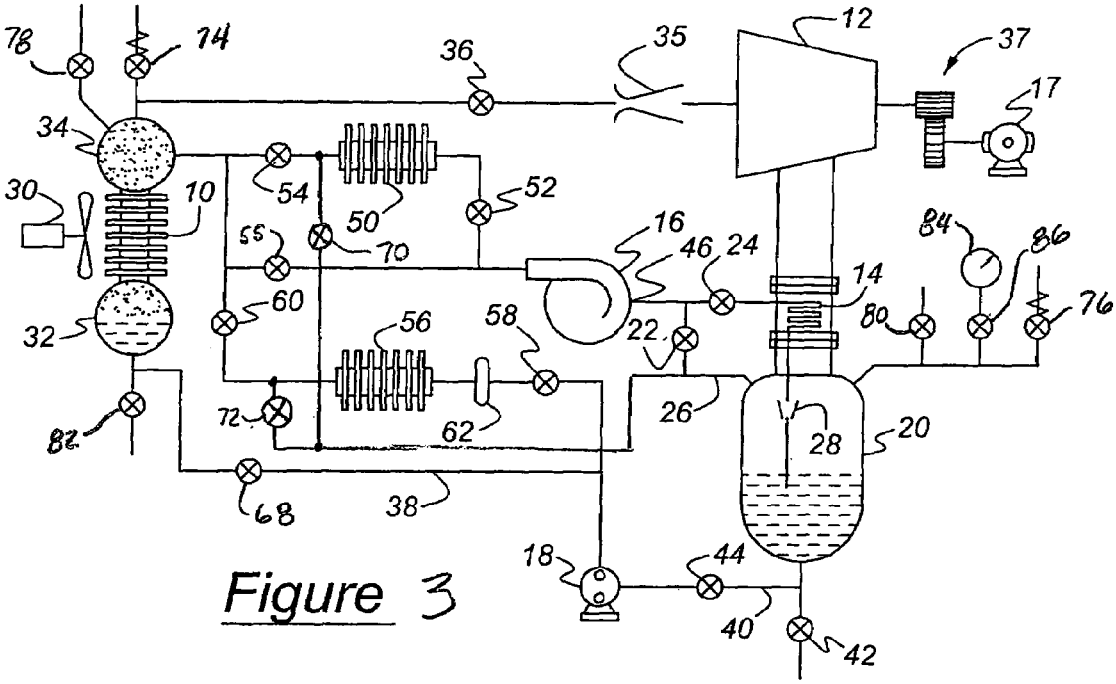
FIG. 3 is a schematic diagram showing an alternate embodiment of the system of FIGS. 1 and 2.

FIG. 3 shows that liquid discharge fluid exiting heat exchanger 50 may be returned through valve 70 to accumulator 20 instead of, or in addition to flowing to vapor drum 34. Similarly, vaporized discharge fluid exiting heat exchanger 56 may be returned through valve 72 to accumulator 20 instead of, or in addition to flowing to vapor drum 34.

The various fluid flow paths are opened and closed using additional flow control valve 68; the system components are protected from over pressurization using pressure relief valves 74, 76; vent valves 78, 80 and fill valves 42, 82 allow charging and discharging the working fluid during startup or maintenance; and process pressure is monitored by pressure gauge 84, which is opened to accumulator 20 through valve 86.

Calculations of the Thermodynamic States:

1. Conversions
   1BTU/lbm=2.326 J/g=2.326 kJ/kg
   1 W=1 J/sec
   1 Hp=745.7 J/sec=745.7 W=0.7457 kW
   1 Hp=42.4 BTU/min
   1 BTU=778 ft-lb=0.000393 Hp-hr
   1 BTU/hr=0.000393 Hp
   12000 BTU=1 ton AC capacity
   1 $m^3$=610223.7 $in^2$=264.172 gal=36.3147 ft3
   1 psi=0.06895 mPa
   1 psi=2.3067=ft of water (head)
   ° R=° F.+459.69
   ° C.=° K+273.16

2. Formulae
   Circumference=$2\pi r=\pi d$
   Velocity of rotation=$v_r=\pi d$/sec
   Angular velocity=$\omega=2\pi f$ (f=frequency in seconds)
   Inlet velocity=$v_i=2\ v_r$
   dynamic viscosity=$v_d$
   kinematic viscosity $v_k=v_d/\rho$
   $\rho$=density (from tables)
   $P_1V_1=P_2V_2$
   $f_m$=mass flow=lb/sec=kg/sec
   $f_v$=volumetric flow=cfm=1/sec
   $k=c_p/c_v$
   Disk Turbine Disk spacing=$D=\pi\sqrt{(v_k/\omega)}$.
   Total BTU/hr (BTUH)=1.085×SCFM×ΔT(dry bulb) (air to fluid Hx)
   Total BTU/hr (BTUH)=488×GPM×ΔT(water) (water to fluid Hx)

3. Thermodynamic States

HFC-134a Saturation Properties-Temperature Table

| | | VOLUME ft3/lb | | DENSITY lb/ft3 | | ENTHALPY Btu/lb | | | ENTROPY Btu/(lb)(° R) | | |
|---|---|---|---|---|---|---|---|---|---|---|---|
| TEMP. ° F. | PRESSURE Psia | LIQUID Vf | VAPOR vg | LIQUID 1/vf | VAPOR 1/vg | LIQUID hf | LATENT hfg | VAPOR hg | LIQUID sf | VAPOR sg | TEMP. ° F. |
| −60 | 3.996 | 0.0111 | 10.3306 | 90.27 | 0.0968 | −5.9 | 100.0 | 94.2 | −0.0143 | 0.2360 | −60 |
| −53 | 5.003 | 0.0112 | 8.3752 | 89.59 | 0.1194 | −3.8 | 99.1 | 95.2 | −0.0093 | 0.2343 | −53 |
| −17 | 13.927 | 0.0116 | 3.2031 | 86.00 | 0.3122 | 6.9 | 93.7 | 100.6 | 0.0160 | 0.2277 | −17 |
| 30 | 40.800 | 0.0124 | 1.1538 | 80.96 | 0.8667 | 21.6 | 85.9 | 107.4 | 0.0473 | 0.2227 | 30 |
| 45 | 54.787 | 0.0126 | 0.8675 | 79.24 | 1.1527 | 26.4 | 83.1 | 109.5 | 0.0570 | 0.2217 | 45 |
| 60 | 72.167 | 0.0129 | 0.6622 | 77.43 | 1.5102 | 31.4 | 80.2 | 111.5 | 0.0666 | 0.2208 | 60 |
| 70 | 85.890 | 0.0131 | 0.5570 | 76.18 | 1.7952 | 34.7 | 78.1 | 112.8 | 0.0729 | 0.2203 | 70 |
| 75 | 93.447 | 0.0132 | 0.5119 | 75.54 | 1.9536 | 36.4 | 77.0 | 113.4 | 0.0761 | 0.2201 | 75 |
| 80 | 101.494 | 0.0134 | 0.4709 | 74.89 | 2.1234 | 38.1 | 75.9 | 114.0 | 0.0792 | 0.2199 | 80 |
| 85 | 110.050 | 0.0135 | 0.4337 | 74.22 | 2.3056 | 39.9 | 74.8 | 114.6 | 0.0824 | 0.2196 | 85 |
| 90 | 119.138 | 0.0136 | 0.3999 | 73.54 | 2.5009 | 41.6 | 73.6 | 115.2 | 0.0855 | 0.2194 | 90 |
| 95 | 128.782 | 0.0137 | 0.3690 | 72.84 | 2.7102 | 43.4 | 72.4 | 115.8 | 0.0886 | 0.2192 | 95 |
| 100 | 138.996 | 0.0139 | 0.3408 | 72.13 | 2.9347 | 45.1 | 71.2 | 116.3 | 0.0918 | 0.2190 | 100 |
| 105 | 149.804 | 0.0140 | 0.3149 | 71.40 | 3.1754 | 46.9 | 69.9 | 116.9 | 0.0949 | 0.2188 | 105 |
| 110 | 161.227 | 0.0142 | 0.2912 | 70.66 | 3.4337 | 48.7 | 68.6 | 117.4 | 0.0981 | 0.2185 | 110 |
| 115 | 173.298 | 0.0143 | 0.2695 | 69.89 | 3.7110 | 50.5 | 67.3 | 117.9 | 0.1012 | 0.2183 | 115 |
| 120 | 186.023 | 0.0145 | 0.2494 | 69.10 | 4.0089 | 52.4 | 65.9 | 118.3 | 0.1043 | 0.2181 | 120 |

HFC-134a Superheated Vapor-Constant Pressure Tables

PSIA PRESSURE = 4.00 PSIA

| | V | H | S | Cp | Cp/Cv | vs | TEMP ° F. |
|---|---|---|---|---|---|---|---|
| SAT LIQ | 0.01108 | −5.9 | −0.0143 | 0.2910 | 1.5092 | 2829.0 | −60 |
| SAT VAP | 10.31992 | 94.2 | 0.2360 | 0.1700 | 1.1467 | 464.1 | −60 |

PRESSURE = 5.00 PSIA

| TEMP ° F. | V | H | S | Cp | Cp/Cv | vs | |
|---|---|---|---|---|---|---|---|
| −53 | 0.01116 | −3.8 | −0.0093 | 0.2929 | 1.5071 | 2768.7 | SAT LIQ |
| −53 | 8.37521 | 95.2 | 0.2343 | 0.1726 | 1.1471 | 466.8 | SAT VAP |

PSIA PRESSURE = 14.00 PSIA

| | V | H | S | Cp | Cp/Cv | vs | TEMP ° F. |
|---|---|---|---|---|---|---|---|
| SAT LIQ | 0.01163 | 7.0 | 0.0161 | 0.3035 | 1.5044 | 2459.9 | −16.8 |
| SAT VAP | 3.18776 | 100.7 | 0.2277 | 0.1876 | 1.1535 | 77.6 | −16.8 |
| | 3.24570 | 101.9 | 0.2305 | 0.1885 | 1.1498 | 481.8 | −10 |
| | 3.65764 | 111.5 | 0.2508 | 0.1964 | 1.1294 | 510.7 | 40 |
| | 3.73832 | 113.5 | 0.2547 | 0.1982 | 1.1263 | 516.1 | 50 |
| | 3.81825 | 115.5 | 0.2586 | 0.2001 | 1.1235 | 521.5 | 60 |
| | 3.89712 | 117.5 | 0.2624 | 0.2020 | 1.1209 | 526.7 | 70 |
| | 3.97614 | 119.6 | 0.2662 | 0.2040 | 1.1185 | 531.9 | 80 |

-continued

HFC-134a Superheated Vapor-Constant Pressure Tables

| | | | | | | |
|---|---|---|---|---|---|---|
| 4.05515 | 121.6 | 0.2700 | 0.2060 | 1.1162 | 536.9 | 90 |
| 4.13394 | 123.7 | 0.2737 | 0.2080 | 1.1141 | 541.9 | 100 |

4. Thermodynamic States

State 1 is the liquid content of accumulator 20. It was chosen to be at 14 psia. because the temperature for bulk boiling of R134-a at 14 psia. is −17° F. This demonstrates the ability to set the internal conditions at or below temperatures encountered from Fall to Spring. This is also the state at the inlet to the feed pump 18.

PSIA PRESSURE = 14.00 PSIA

| | V | H | S | Cp | Cp/Cv | vs | TEMP ° F. |
|---|---|---|---|---|---|---|---|
| SAT LIQ | 0.01163 | 7.0 | 0.0161 | 0.3035 | 1.5044 | 2459.9 | −16.8 |
| SAT VAP | 3.18776 | 100.7 | 0.2277 | 0.1876 | 1.1535 | 77.6 | −16.8 |

State 2 is the high pressure feed pump 18 outlet condition. These are determined by the pressure of R134a at the ambient conditions. These are 45° F. for the boiler pressure and −17° F. for the temperature conditions.

TABLE 1

| T | P | Vf | vg | 1/vf | 1/vg | hf | hfg | hg | sf | sg |
|---|---|---|---|---|---|---|---|---|---|---|
| −17 | 13.927 | 0.0116 | 3.2031 | 86.00 | 0.3122 | 6.9 | 93.7 | 100.6 | 0.0160 | 0.2277 |
| 30 | 40.800 | 0.0124 | 1.1538 | 80.96 | 0.8667 | 21.6 | 85.9 | 107.4 | 0.0473 | 0.2227 |
| 45 | 54.787 | 0.0126 | 0.8675 | 79.24 | 1.1527 | 26.4 | 83.1 | 109.5 | 0.0570 | 0.2217 |

At 45° F., pressure is 54.7 psia. Since temperature is still −17° F., the fluid will be saturated liquid at 54.7 psia or,

| T | P | Vf | vg | 1/vf | 1/vg | hf | hfg | hg | sf | sg |
|---|---|---|---|---|---|---|---|---|---|---|
| −17 | 54.787 | 0.0116 | 3.2031 | 86.00 | 0.3122 | 6.9 | 93.7 | 100.6 | 0.0160 | 0.2277 |

At P=54.787 psia and T=−17° F.,

| vf | 1/vf | u2 | hf | sf |
|---|---|---|---|---|
| 0.011639993 | 85.9104 | 6.7603 | 6.8783 | 0.015694892) |

State 3 is the boiler/heat exchanger 10 outlet condition. These are determined by the pressure of R134a at the external ambient (heat exchanger inlet) conditions. These are set at 45° F. for the demonstration projects. This is also the turbine nozzle inlet state. At other ambient temperatures, a throttling valve or other flow/pressure regulating device can be used to obtain the desired mass flow rate.

| ° F. | Psia | Vf | vg | 1/vf | 1/vg | hf | hfg | hg |
|---|---|---|---|---|---|---|---|---|
| 45 | 54.787 | 0.0126 | 0.8675 | 79.24 | 1.1527 | 26.4 | 83.1 | 109.5 |

State 4 is the turbine nozzle discharge condition. Pressure is converted into velocity in the convergent/divergent nozzle and the pressure is the same as the back pressure of the turbine (14 psia) and the temperature is still at 45° F.

For superheated vapor at 14 psia:

| PSIA PRESSURE = 14.00 PSIA | | | | | | |
|---|---|---|---|---|---|---|
| V | H | S | Cp | Cp/Cv | vs | TEMP ° F. |
| 3.65764 | 111.5 | 0.2508 | 0.1964 | 1.1294 | 510.7 | 40 |
| 3.73832 | 113.5 | 0.2547 | 0.1982 | 1.1263 | 516.1 | 50 |

For 45° F. Interpolating gives:

3.69798 112.5 0.25275 0.1973 1.12785 513.4 45

State 5 is the condition at the turbine 12 discharge into the accumulator 20-reverse flow heat exchanger 14. Both 100% and 80% liquefaction of the fluid are presented and addressed.

With load and heat inlet adjusted for 100% liquefaction, turbine discharge is at State 1 conditions: $v=v_f$, $\rho=1/v_f$, $h=h_f$.

| PSIA PRESSURE = 14.00 PSIA | | | | | | |
|---|---|---|---|---|---|---|
| | V | H | S | Cp | Cp/Cv | vs | TEMP ° F. |
| SAT LIQ | 0.01163 | 7.0 | 0.0161 | 0.3035 | 1.5044 | 2459.9 | −16.8 |

With 80% liquefaction, the conditions are for 20% vapor and

| PSIA PRESSURE = 14.00 PSIA | | | | | | | |
|---|---|---|---|---|---|---|---|
| | V | H | S | Cp | Cp/Cv | vs | TEMP ° F. |
| SAT LIQ | 0.01163 | 7.0 | 0.0161 | 0.3035 | 1.5044 | 2459.9 | −16.8 |
| SAT VAP | 3.18776 | 100.7 | 0.2277 | 0.1876 | 1.1535 | 77.6 | −16.8 |

With 80% saturated liquid conditions: (Interpolated)

| V | H | S | Cp | Cp/Cv | vs | ° F. |
|---|---|---|---|---|---|---|
| 0.646856 | 25.74 | 0.05842 | 0.28032 | 1.43422 | 1983.44 | −16.8 |

State 6 is the conditions on the compressor suction side of the turbine discharge/accumulator inlet heat exchanger.

These conditions have been chosen to be at 4 psia to provide a to provide a significant enough difference in temperature between turbine discharge and the Von Linde side of the process to ensure 100% liquefaction under all turbine condensing conditions. The mass flow of expanded liquid, warmed by the turbine discharge, on the compressor suction side of the heat exchanger are:

| PSIA PRESSURE = 4.00 PSIA | | | | | | | |
|---|---|---|---|---|---|---|---|
| | V | H | S | Cp | Cp/Cv | vs | TEMP ° F. |
| SAT VAP | 10.31992 | 94.2 | 0.2360 | 0.1700 | 1.1467 | 464.1 | −60 |

5. Mass Flows

The mass flow requirement is determined by the power output desired. The power is 15 shaft horsepower. Flows are derived from the need to produce this power with a 45° F. energy source.

1 Hp=42.4 BTU/min, so 15 Hp=636 BTU/min or 38160 BTU/hr.

At 45° F., P=54.787 psia, $v_g$=0.8675 $ft^3$/lb, ρ=1.1527 lb/ft3 and $h_g$=109.5 Btu/$lb_m$.

So, 38160 BTU/hr divided by 109.5 BTU/$lb_m$=348.6 $lb_m$/hr=5.81 $lb_m$/min.

At $v_g$=0.8675 ft3/lb, 5.81 $lb_m$ occupies 6.7 $ft^3$ and 6.7 scfm flow is required to give up 15 hp to the turbine. Although higher efficiencies have been achieved, an 85% efficiency is assumed. So, required flow is 6.7 scfm divided by 0.85=7.9 scfm and 6.84 $lb_m$/min.

The return liquid flow (see Section 6, Disk Turbine) then, is 7.9 lbm/min/1.527 lb/$ft^3$=0.08 cfm×7.08452 gal/$ft^3$=0.596 gpm.

Hp (pump)=specific gravity×head×flow/3960×pump efficiency.

ΔP=40 psi (accumulator to boiler)×2.3067=92.1 ft (head)

Per the Crane Co. flow requirements tables, to raise less than 1 gpm to 100 ft requires ⅙ Hp.

According to CP/AAON, for an air to liquid heat exchanger, Total Sensible BTUH—Air side is:

Total BTUH=1.085×SCFM×(Change in Air Dry Bulb temperature)

Where 1.085=Specific Heat of air at 70° F.×min/hr×Density of Std. Air and Specific Heat of air at 70° F.=242.

Density of Std. Air=0.075 lb/ft3.

And, for a liquid-to-liquid heat exchanger,

Total BTUH=Factor×GPM×(Change in Water temperature)

Where Factor=lb/gal×min/hr×Specific heat of water=500 for cooling and 488 for heating.

Specific heat of water=1.0

For an air source, From Glover, for dry air at 1 atm, it can be seen that, for most calculations, we can use k=Cp/Cv of 1.4 throughout the range of −280° F. to +500° F. and we can use Cp=0.240 throughout the range of −150° F. to +150° F.

For air temperatures between −150° F. to +150° F. the total sensible BTUH will be:

Total BTUH=1.085×SCFM×(Change in Air Dry Bulb temperature)

For a 5° F. ΔT in the air source, total BTU into the heat engine will be

Total BTUH=5.17×SCFM

And, for a 10° F. ΔT in the air source, total BTU into the heat engine will be

Total BTUH=10.85×SCFM

And for a 15° F. ΔT in the air source, total BTU into the heat engine will be

Total BTUH=16.275×SCFM

For a heat transfer of 40,000 BTU, (38,200 BTU for 15 HP+some parasitic losses)

For a 5° F. ΔT in the air source, total BTU into the heat engine will be

Total BTUH=5.17×SCFM and the air flow requirement will be:

40,000 BTUH=5.17×SCFM

SCFM=40,000/5.17=7736.9 SCFM

For a 10° F. ΔT in the air source, 40,000 BTUH=10.85×SCFM

SCFM=40,000/10.85=3686.7 SCFM

And for a 15° F. ΔT in the air source, 40,000 BTUH=16.275×SCFM yielding

SCFM=40,000/16.275=2456.2 SCFM

Per White Blower Manufacturing Co., 1 Hp can deliver 2000 scfm with a drop of less than 6" static head (water column) across their heat exchangers.

Per Lau Industries, with a 0.3 inch static head across their condensers, 1.896 Hp will deliver 9020 scfm.

Per Ocean Breeze, their marine fan coil units will deliver 4800 for the removal of 120,000 BTU/hr with a 2 Hp motor and, lastly, Per Pool Pack's Sizing and Engineering Guide, 1951 cfm/Hp and 4400 cfm/2 Hp (at 1.5 inch WC).

This indicates that at least 1000 scfm/Hp can be readily obtained and that the largest power consumption will be for the fan to blow the air heat source. It also shows that even with inlet temperatures in the 45–50° F. range, this load can be handled in conjunction with the pump and compressor loads and still produce useable amounts of power.

If cooling the air while extracting the useful work is the desired outcome, higher ΔTs and lower flow rates are required.

Extracting 15 Hp and producing a 60° F. outlet temperature, (Flow requirements rounded up.)

| Ti | ΔT | multiplier ($CpX60X\rho_T$) | SCFM |
|---|---|---|---|
| 80 | 20 | 21/7 | 1760 |
| 85 | 25 | 27.125 | 1410 |
| 90 | 30 | 37.55 | 1170 |
| 95 | 35 | 37.975 | 1010 |
| 100 | 40 | 43.4 | 880 |
| 105 | 45 | 48.825 | 785 |

-continued

| Ti | ΔT | multiplier ($CpX60X\rho_T$) | SCFM |
|---|---|---|---|
| 110 | 50 | 54.25 | 705 |
| 115 | 55 | 59.675 | 640 |

If storing the energy in a battery, or transmitting it, a 10×20×10 ft room at 95° F. would be cooled below the point where the engine would cease to function in approximately three minutes.

For a fluid (water) heat source:

And, for a liquid to liquid heat exchanger, (from CP/AAON)

Total BTUH=Factor×GPM×(Change in Water temperature)

Where Factor=lb/gal×min/hr×Specific heat of water=500 for cooling and 488 for heating.

Specific heat of water=1.0 we will always be heating our working fluid, so we will use 488. 15 Hp=38,200 BTUH For ΔT = 10° F.,
Total BTUH = 4880 X GPM and
GPM = 38200/4880 = 7.82 GPM
For ΔT = 15° F.,
Total BTUH = 7320 X GPM and
GPM = 38200/7320 = 5.22 GPM
For ΔT = 20° F.,
Total BTUH = 9760 X GPM and
GPM = 38200/9760 = 33.9 GPM
For ΔT = 25° F.,
Total BTUH = 12200 X GPM and
GPM = 38200/12200 = 3.13 GPM
For ΔT = 30° F.,
Total BTUH = 14640 X GPM and
GPM = 38200/14640 = 2.61 GPM
For ΔT = 35° F.,
Total BTUH = 17080 X GPM and
GPM = 38200/17080 = 2.24 GPM
For ΔT = 40° F.,
Total BTUH = 19520 X GPM and
GPM = 38200/19520 = 1.96 GPM Therefore, for a utility power plant to cool 110,000 gpm from 105° F. to 75° F., ΔT=30° F. and Total BTUH=488×ΔT×110,000=1,610,400,000 BTU/hr (~39 Billion BTU/day).

1,610,400,000 BTU/hr×0.000353 BTU/Hp=632,887 HP or 1,610,400,000 BTU/hr×0.00029 BTU/kW=467.016 kW.

For quality=0 at turbine out (100% liquefaction), with a single stage impulse turbine (for large sizes like this, multi-stage reaction turbines with a final impulse turbine stage would be better):

Using the Du Pont Saturation Tables, working fluid mass flow (w)=1.69E+9 BTU/hr/102.5 BTU/lb (105° F.)=15,711,220 lb/hr=261,854 lb/min.

$$\text{vapor volumetric flow } (vg) = 261{,}854 \text{ lb/min}/1.1527 \text{ lb}/cu-\text{ft} = 227{,}166\ cfm.$$

$$\text{Liquid return } (vf) = 261{,}854 \text{ lb/min}/85.98 \text{ lb}/cu-\text{ft} = 3045\ cfm = 22781\ gpm.$$

For quality=20 at turbine out (80% liquefaction), again with a single stage impulse turbine:

Using the Du Pont Saturation Tables, w=1.69E+9 BTU/hr/83.76 BTU/lb (105° F.)=19,226,361 lb/hr =320,440 lb/min.

$$\text{vapor volumetric flow } (vg) = 320{,}440 \text{ lb/min}/1.1527 \text{ lb}/cu-\text{ft} = 227{,}911\ cfm.$$

$$\text{Liquid return } (vf) = 261{,}854 \text{ lb/min}/85.98 \text{ lb}/cu-\text{ft} = 3727\ cfm = 27{,}878\ gpm.$$

Disk Turbine Disk spacing=$D=\pi\sqrt{(\nu_k/\omega)}$ and

Angular velocity=$\omega=2\pi f$ (f=frequency in seconds)

Frequency=7200 rpm=120/sec.

$\omega=6.28(120)/\text{sec}=753.6/\text{sec}.$ $D=\pi\sqrt{(1.59261\text{E-}06\ \text{ft}^2\text{-sec}\times144\ \text{in}^2/\text{ft}^2\times753.6/\text{sec})}=\pi\sqrt{(0.000000304)}=\pi(0.000551652)=0.001733065$ inches.

D=0.0017 inches.

Radii for disk turbomachinery is commonly determined from Hasinger and Kehrt's spacing determination:

$$A=q\delta/\nu r_i^2$$

Where A is a dimensionless number related to the flow through each disk space, q is the flow rate, δ is the disk spacing in inches, ν is the kinematic viscosity ($\nu_k$) and $r_i$ is the inlet radius. For a turbine, this is the outer radius of the disk. For a compressor or pump, it is the inner disk radius.

For the turbine, the flow rate from above is 7.9 scfm (at 85% efficiency) to produce 15 Hp. δ=D=0.0017 inches; $\nu_k$=1.59261E-06 ft$^2$-sec. The inlet (outer) radius is about 6 inches.

Because the number of required spaces is so low, use A=5.

$5=(7.9\ \text{ft}^3/\text{min}/60\ \text{sec/min}\times0.001733065\ \text{in}/12\ \text{in/ft})/(1.59261\text{E-}06\ \text{ft}^2\text{-sec}\times\times r_i^2(\text{ft}^2))$.

$5=0.386784\ \text{ft}^4/\text{sec}/(0.000229\ \text{ft}^2\text{-sec}\times r_i^2\ \text{ft}^2)=1686.541\ \text{ft}^2/r_i2\ (\text{ft}^2)$ $r_1^2=1.175516475\ \text{ft}^2/5=0.235103295\ \text{ft}^2$ $r_i=\sqrt{0.235103295\ \text{ft}^2}=0.484874515\ \text{ft}\times12$ in/ft=5.818494176 in Rounded up to 6 inches outer diameter.

With 5% of flow per disk space, 39 disk spaces are needed, or 41 disks to handle the 7.9 scfm of flow plus two additional disks to replace the labyrinth seals and two face plates. With 0.012 inch thick disks, this gives a rotor thickness of 0.551 inches +0.0034 for the space between the active disks and face plates +2×0.025 (40 gage) plates for a total rotor thickness of 0.6044 inches.

Note: At 80° F., $\nu_d$=0.027 lb/ft-hr=0.0000075 lb/ft-sec $\nu_k=\nu_d/\rho=0.0000075/2.1234\ \text{ft}^2\text{-sec}=3.53207\text{E-}06\ \text{ft}^2\text{-sec}$ This gives a stack of only 26 active spaces with a 6 inch diameter.

The temperature and kinetic viscosity must always be considered when using disk turbines.

A minimum inner/outer disk radius ratio of 2.5 is too low. Use a ratio of 3.0 to increase the flow path and to increase the amount of condensate.

The liquid through the discharge then, is 7.9 lbm/min/1.1527 lb/ft$^3$=0.08 cfm

×7.08452 gal/ft$^3$=0.596 gpm.

The discharge radius=$\pi-(3/4)^2\pi=\pi(1-0.5625)=1.37$ in$^2$, which will easily handle 0.6 gpm.

The turbine design information is included for completeness. Other prime movers could be used, including, but not limited to bladed turbines and piston engines.

For complete design reference, see "A Quantitative Analysis of the Tesla Turbomachine" by Glen A Barlis, and U.S. Pat. No. 1,061,206 issued to Nikola Tesla.

6. Nozzle Mass Flow

For a turbine operated in the impulse mode, peak power transfer will occur when the entrance velocity is twice the peripheral velocity of the disk or rotor blade tip. This enables us to run the turbine significantly over stall and get most of the condensation occurring in the boundary layers between the disks.

The pressure throughout the jet is always the same as the back pressure, unless the jet is supersonic and there are shocks or there are expansion waves in the jet to produce pressure differences.

For a six-inch disk at 7200 rpm, edge velocity is 376.8 ft/sec. The jet velocity needs to be twice this or 753.6 ft/sec. (~0.8 Mach)

Flow is 7.9 cfm/60=0.132 ft$^3$/sec.

The nozzle area must therefore be (volumetric flow/velocity) 0.132/753.6 ft$^2$=0.0001747169 ft$^2$×144=0.2516 in$^2$ For a circular nozzle, the radius would be 0.50 in.

Should a manufacturer use exchangeable disk packs and nozzle configurations, with or without wide range control valves for the compressor feed, the turbines would be operable under a very wide range of temperatures and loads.

7. Von Linde Expansion/Counter Flow Process

At the turbine outlet, pressure is 14 psia and temperature is −16.8° F. Presuming a liquefaction of 80% (quality of 20), 20% of the flow still has the gas enthalpy of 100.7 BTU/lb instead of the 7 BTU/lb of the liquid. $h_{fg}$=93.7 BTU/lb.

At 85% mechanical efficiency, mass flow is 6.84 lbm/min. 20% of this, or 1.37 lbm of vapor, needs to be condensed. This means that 1.37 lbm/min×93.7 BTU/lb, or 128.37 BTU/min needs to be absorbed.

At 4 psia, T=−60° F. and $h_{fg}$=100.0 BTU/lb. This gives a 43 degree differential temperature to drive the heat transfer and only 1.28 lbm/min needs to be vaporized on the compressor suction side of the heat exchanger.

ρ=0.0968 lb/ft$^3$, so the compressor inlet flow is 13.22 cfm of 4 psia vapor at −60.° F. The liquid flow being vaporized is 1.37 lbm/min/90.27 lb/ft$^3$=0.015 cfm=0.000253 ft$^3$/sec.

The area of the an orifice to limit liquid flow from the accumulator liquid reservoir to the heat exchanger section is determined by Q=AVK, where A is the area of the orifice in sq-ft, Q is the flow in cu-ft/sec and V is the flow velocity in ft/sec and K is the resistance factor determined by the shape of the orifice.

V can be converted to head across the orifice at $v=0.824\sqrt{h}$ where h is the head across the orifice in feet. Head=(14-4)/30=0.3 ft.

And the flow equation is $Q=(A\times8.02\times K\times4\sqrt{h})/144$ to give square inches.

Solving for area A $A=144\ Q/(8.02\times K\times4\sqrt{h})=144(0.000253)/(8.02\times K\times0.3)$ sq-in.

A=0.015/K sq-in.

For a flat plate orifice with a thickness between two and three times the diameter of the orifice, K=0.82.

A then=0.0183 sq-in and diameter=0.153 inches. The orifice plate is between 0.3 and 0.45 inches thick.

The flow rate is can also be controlled by an expansion valve, venturi, or throttling valve. Preferably, an expansion valve is used for fine control.

The compressor 16 discharges into the boiler steam drum segment 34, the upper manifold of the tube fin heat exchanger. The decreased pump and fan flow requirements have been ignored.

The power to raise a gas pressure from 1 atmosphere to 125 psi (pressure at ~80° F.) is approximately 28% of the compressor flow capacity.

To raise the pressure in this example from 4 to 54 psi, about ⅓ of this power is required. We will use 14%.

13.22 cfm×0.14 Hp/cfm=1.8 Hp.

8. Power and Efficiencies

15 HP output (calculation basis for all flow requirements).

Pump: ⅙ Hp

Compressor: 1.8 Hp

Fan: 3.5 Hp (using a 5° F. air ΔT)

Net power=15−⅙−1.8−3.5=9.53 Hp=7.13 kW.

Mechanical efficiency (η)=9.53/15=63.5%

(With 10° F. air ΔT, Net is 11.03 hp and η=73.5%)

Thermo-Mechanical Efficiency ($\eta_T$):

2.53 Hp×2511.3 BTU/hr/38200 BTU/hr=0.626=62.6%

(With 10° F. air ΔT, $\eta_T$=72.5%)

Which matches allowing for conversion roundoff.

Carnot Efficiency ($\eta_C$)

TH−TC/TH=(45−(−19))° R/(45° F.+459.69)=12.676%

| TH | TC | dT | Eff-C |
|---|---|---|---|
| 45 | −19 | 64 | 0.126760 |
| 60 | −19 | 79 | 0.151955 |
| 80 | −19 | 99 | 0.183371 |
| 90 | −19 | 109 | 0.198221 |
| 100 | −19 | 119 | 0.212542 |
| 115 | −19 | 134 | 0.233088 |
| 250 | −19 | 269 | 0.378932 |

250 is for direct conversion of power plant steam or a thermal connection to an automobile or truck radiator.

As with any Carnot cycle, the efficiency increases as the inlet temperature increases.

It is not only theoretically feasible to run a low temperature heat engine without recourse to an external heat sink, it is practical in the sense of useable power output developed, even at significantly low temperatures.

What is claimed is:

1. A method for producing power to drive a load using a working fluid circulating through a system that includes a prime mover having an inlet, an accumulator containing discharge fluid from the prime mover, the method comprising the steps of:

expanding a high velocity stream of heated vaporized fluid at relatively high pressure through the prime mover to a lower pressure discharge side of the prime mover where discharge fluid exits the prime mover;

vaporizing the discharge fluid by passing the discharge fluid through an expansion device across a pressure differential to a lower pressure than the pressure at the prime mover discharge side;

transferring latent heat of condensation from discharge fluid being discharged from the prime mover to the discharge fluid that has passed through the expansion device;

heating and vaporizing discharge fluid to which heat has been transferred from fluid being discharged from the prime mover; and returning the heated vaporized fluid to the prime mover inlet.

2. The method of claim 1, further comprising:

maintaining the prime mover discharge at the relatively lower pressure by pumping vaporized discharge fluid discharged from the prime mover and contained in an accumulator to the prime mover inlet.

3. The method of claim 1, further comprising:

maintaining the prime mover discharge at the relatively low pressure by pumping liquid discharge fluid discharged from the prime mover and to a heat exchanger.

4. The method of claim 1, wherein the step of vaporizing the discharge fluid by passing discharge fluid through an expansion device across a pressure differential, further comprises:

arranging an expansion device having an intake side and an outlet side such that the intake side communicates with the discharge side of the prime mover and the outlet side communicates with a compressor inlet; and using the compressor to produce a relatively lower pressure at the expansion device outlet side than a pressure at the expansion device intake side.

5. The method of claim 1, wherein the step of vaporizing the discharge fluid by passing discharge fluid through an expansion device across a pressure differential, further comprises:

reducing a temperature of the discharge fluid that has passed through the expansion device to a temperature lower than the temperature of fluid being discharged from the prime mover;

causing the discharge fluid that has passed through the expansion device to flash boil and extract latent heat of condensation from the discharge fluid being discharged from the prime mover.

6. The method of claim 1, wherein the step of vaporizing the discharge fluid by passing discharge fluid through an expansion device across a pressure differential, further comprises expanding the discharge fluid isobarically.

7. The method of claim 1, further comprising:

producing the high velocity fluid stream by passing the heated vaporized fluid through a convergent-divergent nozzle across a pressure differential.

8. The method of claim 1, further comprising:

scavenging vaporized discharge fluid that has passed through the expansion device;

compressing the scavenged discharge fluid; and returning the heated vaporized fluid to the prime mover inlet.

9. The method of claim 1, further comprising:

supplying the system with a working fluid having a positive Joule-Thompson coefficient over a range of system operation.

10. The method of claim 9, further comprising:

supplying the system with a working fluid that is refrigerant 134-*a*.

11. The method of claim 1, further comprising the steps of:

pumping liquid discharge fluid from the discharge side of the prime mover to a heat exchanger;

heating and vaporizing discharge fluid pumped from the discharge side of the prime mover using the heat exchanger and a heat source; and returning the heated vaporized discharge fluid from the heat exchanger to the prime mover inlet.

12. The method of claim 11, wherein the step of heating and vaporizing discharge fluid pumped from the discharge side of the prime mover using the heat exchanger and a heat source, further comprises:

using as the heat source one of ambient air and process cooling water.

13. The method of claim 11, further comprising the steps of:

heating and vaporizing at least a portion of the liquid discharge fluid that is pumped from the discharge side of the prime mover using a heat source; and supplying the heated vaporized discharge fluid to the prime mover inlet.

14. The method of claim 1, further comprising the steps of:

pumping vaporized discharge fluid that has passed through the expansion device to the prime mover inlet; and transferring heat to a heat source from at least a portion of the vaporized discharge fluid that has passed through the expansion device.

15. A system for generating power using a fluid in which energy is stored and removed, comprising:

a prime mover for driving a load, having an inlet and discharge side, though which prime mover heated vaporized fluid at relatively high pressure is expanded to a lower pressure at the discharge side where discharge fluid exits the prime mover;

an accumulator containing discharge fluid from the prime mover;

a boiler for heating and vaporizing discharge fluid from the prime mover; and a device for pumping from the accumulator to the boiler vaporized discharge fluid discharged from the prime mover; and a pump for delivering liquid fluid from the accumulator to the boiler.

16. The system of claim 15, further comprising:

an expansion device for vaporizing discharge fluid from the prime mover by passing the discharge fluid through the expansion device across a pressure differential to a lower pressure than a pressure at the prime mover discharge side;

a first heat exchanger for transferring latent heat of condensation from the discharge fluid discharged from the prime mover to the discharge fluid that has passed through the expansion device; and wherein the pumping device pumps to the boiler vaporized discharge fluid that has passed through the expansion device and first heat exchanger.

17. The system of claim 15, wherein the prime mover is any of a disk turbine, a blade turbine, a centrifugal turbine, a vane motor, and a piston motor.

18. The system of claim 15, wherein the device for pumping is any of a compressor and a blower.

19. The system of claim 15, wherein the fluid has a positive Joule-Thompson coefficient in the range of system operation.

20. The system of claim 15, wherein the fluid is refrigerant 134-a.

21. The system of claim 15, further comprising:

a heat sink; and a second heat exchanger for transferring heat to the heat sink from the vaporized discharge fluid pumped from the accumulator by the pumping device.

22. The system of claim 15, further comprising:

a heat sink;

a second heat exchanger for transferring heat to the heat sink from the vaporized discharge fluid pumped from the accumulator by the pumping device; and a fluid line for carrying to the accumulator fluid that has passed through the second heat exchanger.

23. The system of claim 15, further comprising:

a heat sink; and a second heat exchanger for transferring heat to the heat sink from the vaporized discharge fluid that has passed through the expansion device and first heat exchanger.

24. The system of claim 15, further comprising:

a heat sink; and a second heat exchanger for transferring heat to the heat sink from the vaporized discharge fluid that has passed through the expansion device and first heat exchanger; and a fluid line for carrying to the accumulator fluid that has passed through the second heat exchanger.

25. The system of claim 15, further comprising:

a heat source; and a second expansion device through which liquid discharge fluid from the accumulator is expanded; and a third heat exchanger for transferring heat from the heat source to the discharge fluid that has passed through the second expansion device; and a second fluid line for carrying to the boiler at least a portion of the liquid discharge fluid that has passed through the third heat exchanger.

26. The system of claim 15, further comprising:

a heat source; and a second expansion device through which liquid discharge fluid from the accumulator is expanded;

a third heat exchanger for transferring heat from the heat source to the discharge fluid that has passed through the second expansion device; and a second fluid line for carrying to the boiler at least a portion of the liquid discharge fluid that has passed through the third heat exchanger; and a third fluid line for carrying to the accumulator fluid that has passed through the third heat exchanger.

27. A method for producing power to drive a load using a working fluid circulating through a system that includes a prime mover having an inlet, an accumulator containing discharge fluid from the prime mover, the method comprising the steps of:

expanding a high velocity stream of heated vaporized fluid at relatively high pressure through the prime mover to a lower pressure discharge side of the prime mover, such that fluid exiting the prime mover is condensed without transferring heat of the vapor to an external heat sink;

vaporizing the discharge fluid;

transferring latent heat of condensation from discharge fluid discharged from the prime mover to vaporized discharge fluid;

heating vaporized discharge fluid to which heat has been transferred from fluid discharged from the prime mover; and returning the heated vaporized fluid to the prime mover inlet.

28. The method of claim 27, wherein the step of vaporizing the discharge fluid further comprises:

vaporizing the discharge fluid by passing the discharge fluid through an expansion device across a pressure differential to a lower pressure than the pressure at the prime mover discharge side; and transferring latent heat of condensation from discharge fluid being discharged from the prime mover to the discharge fluid that has passed through the expansion device.

29. The method of claim 27, wherein the step of vaporizing the discharge fluid further comprises:

maintaining the prime mover discharge at the relatively lower pressure by pumping vaporized discharge fluid discharged from the prime mover to the prime mover inlet.

* * * * *